US012089741B2

(12) United States Patent
Kamiya et al.

(10) Patent No.: US 12,089,741 B2
(45) Date of Patent: Sep. 17, 2024

(54) TILTABLE CHAIR

(71) Applicant: QUALI CO., LTD., Anjo (JP)

(72) Inventors: Nariaki Kamiya, Anjo (JP); Toshiharu Okazaki, Anjo (JP)

(73) Assignee: QUALI CO., LTD., Anjo (JP)

( * ) Notice: Subject to any disclaimer, the term of this patent is extended or adjusted under 35 U.S.C. 154(b) by 0 days.

(21) Appl. No.: 17/619,562

(22) PCT Filed: Jun. 17, 2019

(86) PCT No.: PCT/JP2019/023872
§ 371 (c)(1),
(2) Date: Dec. 15, 2021

(87) PCT Pub. No.: WO2020/255195
PCT Pub. Date: Dec. 24, 2020

(65) Prior Publication Data

US 2022/0378208 A1 Dec. 1, 2022

(51) Int. Cl.
*A47C 1/032* (2006.01)
*A47C 7/44* (2006.01)

(52) U.S. Cl.
CPC ..... *A47C 1/03294* (2013.01); *A47C 7/44* (2013.01); *A47C 1/03261* (2013.01);
(Continued)

(58) Field of Classification Search
CPC ..... A47C 7/44; A47C 7/444; A47C 7/445; A47C 7/4454; A47C 7/46; A47C 7/48;
(Continued)

(56) References Cited

U.S. PATENT DOCUMENTS 293,813 A * 2/1884 St. John ..... B60N 2/34 297/320
1,789,337 A * 1/1931 Knabusch ..... A47C 1/03294 297/342

(Continued)

FOREIGN PATENT DOCUMENTS

DE 4033972 A1 * 4/1992
DE 19924600 A1 * 11/2000 ..... A47C 1/032

(Continued)

OTHER PUBLICATIONS

International Search Report dated Sep. 3, 2019 from counterpart International Patent Application No. PCT/JP2019/23872.

*Primary Examiner* — Rodney B White
(74) *Attorney, Agent, or Firm* — SHUTTLEWORTH & INGERSOLL, P.L.C.; Timothy J. Klima

(57) ABSTRACT

A tiltable chair includes a flexible seat body including an integrally formed seat back and seat surface supported on a seat frame disposed on upper parts of legs, and the seat back connected to a back frame allowing tilting rearwards, the position of the connection being in an area around the upper part of the pelvis of a person seated thereon. A guide rail having an arc-shaped groove is fixed to the seat frame, and guide members which engage and roll in the arc-shaped grooves are pivotably supported on a shaft bracket of the rear surface of the seat surface. The arc-shaped groove has a high center so that the seat surface undergoes curved motion forward and upward such that the ischium is positioned lower than the lower part of the knees when the seat back tilts rearwards.

12 Claims, 16 Drawing Sheets

(52) U.S. Cl.
CPC ..... *A47C 1/03272* (2013.01); *A47C 1/03274* (2018.08); *A47C 1/03279* (2018.08); *A47C 7/443* (2013.01); *A47C 7/444* (2018.08); *A47C 7/445* (2013.01); *A47C 7/4454* (2018.08)

(58) Field of Classification Search
CPC ..... A47C 1/032; A47C 7/443; A47C 1/03261; A47C 1/03272; A47C 1/03274; A47C 1/03279
USPC ..... 297/285, 291, 316, 317, 322, 341, 342, 297/354.11
See application file for complete search history.

(56) References Cited

U.S. PATENT DOCUMENTS 1,802,608 A * 4/1931 Krause ..... A47C 1/03238 297/343 X
2,034,412 A * 3/1936 Neutra ..... A47C 3/021 248/598
2,035,489 A * 3/1936 Mcarthur, Jr. ..... 403/174
2,063,781 A * 12/1936 Ball ..... A47C 3/021 297/286
2,085,804 A * 7/1937 Heimann ..... A47C 5/046 297/411.4
2,838,095 A * 6/1958 Deaton ..... A47C 7/443 297/301.4
3,092,417 A * 6/1963 Drabert ..... A47C 7/48 297/316
3,337,266 A * 8/1967 Burns ..... A47C 1/03274 297/320
3,337,267 A * 8/1967 Rogers, Jr. ..... A47C 1/032 297/340
3,572,829 A * 3/1971 Malitte ..... B64D 11/06 297/317
3,773,383 A * 11/1973 Ekornes ..... A47C 1/03294 297/320
3,863,980 A * 2/1975 Ciner ..... A47C 1/035 297/69
3,934,932 A * 1/1976 Ekornes ..... A47C 1/03294 297/320
3,947,069 A * 3/1976 Lusch ..... A47C 1/0325 297/29
4,045,081 A * 8/1977 Ueno ..... A47C 1/032 297/354.12
4,078,841 A * 3/1978 Kiang ..... A47C 1/032 297/68
4,084,850 A * 4/1978 Ambasz ..... A47C 3/025 297/301.1
4,167,288 A * 9/1979 Kiang ..... A47C 1/032 297/378.1
4,316,632 A * 2/1982 Brauning ..... A47C 7/46 297/291 X
4,333,683 A * 6/1982 Ambasz ..... A47C 7/443 297/301.1 X
4,429,917 A * 2/1984 Diffrient ..... A47C 1/03255 297/303.4
4,452,486 A * 6/1984 Zapf ..... A47C 1/03294 297/343
4,607,883 A * 8/1986 Tzu-Chun ..... A47C 1/024 297/320
4,629,249 A * 12/1986 Yamaguchi ..... A47C 1/03294 297/316
4,641,885 A * 2/1987 Brauning ..... A47C 1/03277 297/292 X
4,653,806 A * 3/1987 Willi ..... A47C 1/03266 297/300.8
4,685,733 A * 8/1987 Machate ..... A47C 7/46 297/303.3
4,711,491 A * 12/1987 Ginat ..... A47C 7/445 297/301.4
4,732,424 A * 3/1988 Uredat-Neuhoff ..... A47C 1/03255 297/320
4,783,121 A * 11/1988 Luyk ..... A47C 3/026 297/303.3
4,786,106 A * 11/1988 Bottemiller ..... A47C 3/0252 297/303.3
4,804,227 A * 2/1989 Hansen ..... A47C 1/03255 297/316
4,834,453 A * 5/1989 Makiol ..... A47C 1/03274 297/DIG. 2
4,840,426 A * 6/1989 Vogtherr ..... A47C 1/03255 297/303.4
4,842,333 A * 6/1989 Meiller ..... A47C 1/03294 297/90
4,889,385 A * 12/1989 Chadwick ..... A47C 7/441 297/285
4,911,501 A * 3/1990 Decker ..... A47C 3/0252 297/285
5,009,466 A * 4/1991 Perry ..... A47C 1/03294 297/300.1
5,071,189 A * 12/1991 Kratz ..... A47C 1/03255 297/316
5,100,201 A * 3/1992 Becker, III ..... A47C 31/126 297/296 X
5,108,149 A * 4/1992 Ambasz ..... A47C 7/443 297/297
5,112,108 A * 5/1992 Zapf ..... A47C 7/445 297/301.1
5,197,781 A * 3/1993 Tada ..... A47C 1/03294 297/375
5,211,444 A * 5/1993 Kjellman ..... A47C 1/03294 297/375
5,263,767 A * 11/1993 Asbjornsen ..... A47C 1/03283 297/320 X
5,295,731 A * 3/1994 Dauphin ..... A47C 1/03294 297/300.1 X
5,318,346 A * 6/1994 Roossien ..... A47C 3/12 297/DIG. 2
5,333,368 A * 8/1994 Kriener ..... A47C 7/444 297/302.1 X
5,338,094 A * 8/1994 Perry ..... A47C 7/44 297/445.1
5,383,712 A * 1/1995 Perry ..... A47C 7/44 297/451.7
5,582,459 A * 12/1996 Hama ..... A47C 1/03255 297/285
5,630,643 A * 5/1997 Scholten ..... A47C 3/12 297/440.16
5,660,439 A * 8/1997 Unwalla ..... A47C 1/03255 297/316
5,785,384 A * 7/1998 Sagstuen ..... A61G 5/1067 297/317
5,810,440 A * 9/1998 Unwalla ..... A47C 1/03294 297/316
5,826,940 A * 10/1998 Hodgdon ..... A47C 1/03294 297/316
5,887,946 A * 3/1999 Raftery ..... A47C 7/405 297/297
5,904,397 A * 5/1999 Fismen ..... A47C 7/405 297/291 X
5,944,382 A * 8/1999 Ambasz ..... A47C 7/443 297/343 X
RE36,335 E * 10/1999 Perry ..... A47C 3/023 297/354.11
6,070,937 A * 6/2000 Ginat ..... A47C 7/445 297/285
6,109,694 A * 8/2000 Kurtz ..... A47C 1/03255 297/320
6,120,097 A * 9/2000 Perry ..... A47C 3/12 297/229
6,296,309 B1 * 10/2001 Kurtz ..... A47C 7/40 297/297
6,435,615 B1 * 8/2002 Zapf ..... A47C 1/032 297/301.1

(56) References Cited

U.S. PATENT DOCUMENTS 6,488,335 B1 * 12/2002 Cioncada ..... A47C 1/03255 297/316
6,513,874 B1 * 2/2003 Sander ..... A47C 1/03255 297/300.2 X
6,523,895 B1 * 2/2003 Vogtherr ..... A47C 3/026 297/300.1
6,523,898 B1 * 2/2003 Ball ..... A47C 1/03 297/320
6,685,267 B1 * 2/2004 Johnson ..... A47C 1/03238 297/316
6,705,677 B2 * 3/2004 Oshima ..... A47C 1/03266 297/342 X
6,709,056 B2 * 3/2004 Bock ..... A47C 1/03294 297/301.4
6,945,602 B2 * 9/2005 Fookes ..... A47C 1/03261 297/300.2 X
7,147,285 B2 * 12/2006 Lin ..... A47C 3/026 297/300.2 X
7,185,951 B2 * 3/2007 Johnson ..... A47C 1/03255 297/301.1
7,188,900 B1 * 3/2007 Raftery ..... A47C 1/03255 297/286
7,226,127 B1 * 6/2007 Yevko ..... A47C 7/46 297/291 X
7,234,772 B2 * 6/2007 Wells ..... A47C 3/027 297/316
7,234,775 B2 * 6/2007 Serber ..... A47C 1/022 297/301.1
7,267,405 B2 * 9/2007 Tin ..... A47C 1/03255 297/316
7,273,253 B2 * 9/2007 Deimen ..... A47C 1/03277 297/303.3
7,278,688 B1 * 10/2007 Hung ..... A47C 7/448 297/285
7,311,361 B2 * 12/2007 Hung ..... A47C 1/0308 297/411.32
7,427,107 B2 * 9/2008 Yang ..... A47C 7/405 297/354.11
7,611,202 B2 * 11/2009 Johnson ..... A47C 1/03255 297/343
7,614,697 B1 * 11/2009 Lai ..... A47C 1/03255 297/301.7
7,625,045 B2 * 12/2009 Hatcher ..... A47C 1/03277 297/300.2
7,794,016 B1 * 9/2010 Lucci ..... A47C 3/045 297/331
7,850,241 B1 * 12/2010 Lucci ..... A47C 1/121 297/331
7,896,439 B2 * 3/2011 Kan ..... A47C 7/4454 297/285
8,474,912 B2 * 7/2013 Lockwood ..... A47C 1/03272 297/342 C
8,613,482 B2 * 12/2013 Ni ..... A47C 1/026 297/302.1 X
8,662,586 B2 * 3/2014 Serber ..... A47C 3/0257 297/316
8,764,110 B2 * 7/2014 Hsuan-Chin ..... A47C 7/44 297/284.7
8,979,199 B2 * 3/2015 Ko ..... A47C 7/448 297/291 X
9,144,311 B2 * 9/2015 Romero ..... A47C 1/03255
9,215,932 B2 * 12/2015 Birkbeck ..... A47C 1/03294
9,241,570 B2 * 1/2016 Jones ..... A47C 1/03255
9,364,091 B2 * 6/2016 Costaglia ..... A47C 1/03294
9,433,296 B2 * 9/2016 Gorgi ..... A47C 4/021
9,462,889 B2 * 10/2016 Piretti ..... A47C 1/03255
9,538,847 B2 * 1/2017 Romero ..... A47C 1/03261
9,554,652 B2 * 1/2017 Birkbeck ..... A47C 1/022
9,585,479 B2 * 3/2017 Keilhauer ..... A47C 1/024
9,622,580 B2 * 4/2017 Slongo ..... A47C 1/03255
9,669,735 B2 * 6/2017 Singla Casasayas .... B60N 2/02
9,700,138 B2 * 7/2017 Rechtien ..... A47C 1/032
10,178,913 B2 * 1/2019 He ..... A47C 1/03274
10,321,763 B2 * 6/2019 Bonneywell ..... A47C 7/445
10,383,445 B2 * 8/2019 Serber ..... A47C 9/002
10,383,448 B1 * 8/2019 VerBeek ..... A47C 1/03255
10,993,536 B2 * 5/2021 Pu ..... A47C 1/03294
11,096,492 B2 * 8/2021 Brais ..... A47C 1/03294
11,166,553 B2 * 11/2021 Vogtherr ..... A47C 7/44
11,166,554 B1 * 11/2021 Romero ..... A47C 7/56
11,178,972 B2 * 11/2021 Ballendat ..... A47C 7/004
11,337,525 B1 * 5/2022 Wu ..... A47C 7/448
11,350,750 B2 * 6/2022 Slongo ..... A47C 1/03294
11,559,141 B2 * 1/2023 Takeya ..... A47C 7/46
11,564,500 B1 * 1/2023 Palma ..... A47C 7/46
11,617,444 B2 * 4/2023 Deevers ..... A47C 1/03277 297/301.1
11,690,455 B2 * 7/2023 Smith ..... A47C 1/03272 297/300.2
11,771,226 B2 * 10/2023 Galiotto ..... A47C 1/024 297/28
2002/0117883 A1 * 8/2002 Gevaert ..... A47C 7/445 297/291
2002/0190555 A1 * 12/2002 Holbrook ..... A47C 7/441 297/300.4
2003/0127896 A1 * 7/2003 Deimen ..... A47C 7/46 297/301.1
2003/0137171 A1 * 7/2003 Deimen ..... A47C 7/029 297/300.1
2006/0244294 A1 * 11/2006 Dozsa-Farkas .... A47C 1/03283 297/300.2
2007/0108818 A1 * 5/2007 Ueda ..... A47C 7/4454 297/291 X
2008/0084100 A1 * 4/2008 Curiger ..... A47C 1/03255 297/300.4
2009/0146476 A1 * 6/2009 Kan ..... A47C 7/46 297/284.4
2011/0074197 A1 * 3/2011 Okamoto ..... A47C 1/03272 297/340
2011/0291452 A1 * 12/2011 Ko ..... A47C 1/03266 297/340
2012/0205952 A1 * 8/2012 Takeuchi ..... A47C 1/03255 297/300.1
2013/0221719 A1 * 8/2013 Costaglia ..... A47C 1/03255 297/340
2014/0028068 A1 * 1/2014 Birkbeck ..... A47C 1/022 297/340
2017/0245643 A1 * 8/2017 Schneider ..... A47C 1/03272
2020/0178690 A1 * 6/2020 Matlin ..... A47C 3/0255
2020/0268155 A1 * 8/2020 Brais ..... A47C 1/03272
2022/0248853 A1 * 8/2022 Schmitz ..... A47C 1/03255
2022/0295995 A1 * 9/2022 Powicki ..... A47C 7/40
2022/0295996 A1 * 9/2022 Piretti ..... A47C 5/04
2023/0103963 A1 * 4/2023 Mullet ..... A47C 7/444 297/301.3

FOREIGN PATENT DOCUMENTS

DE 19938485 A1 * 3/2001 ..... A47C 1/032
EP 0096273 A2 * 12/1983 ..... A47C 1/032
EP 3103369 A1 * 12/2016 ..... A47C 1/03255
FR 2627967 A1 * 9/1989 ..... A47C 1/032
GB 2326586 A * 12/1998 ..... A47C 1/032
JP H05329031 A 12/1993
JP H09510114 A 10/1997
JP 2007167577 A 7/2007
JP 2013000445 A 1/2013
JP 2014004324 A 1/2014
JP 2014097181 A 5/2014
WO WO-0057753 A1 * 10/2000 ..... A47C 1/00
WO WO-2013164078 A1 * 11/2013 ..... A47C 1/024

* cited by examiner (a)

(b)

TILTABLE CHAIR

CROSS-REFERENCE TO A RELATED APPLICATION

This application is the National Phase of International Application PCT/JP2019/023872 filed Jun. 17, 2019 which designated the U.S.

TECHNICAL FIELD

The present invention relates to a simple, lightweight tiltable chair designed with the rearward tilt of the seat back interacting, when the seat back is leaned upon, to push the seat surface forward and upward.

PRIOR ART TECHNOLOGY

The applicant has invented a storable swingable chair that does not promote fatigue, even when seating for a long time, and supports the ability to focus. This chair has a seat frame, on which a seat and seat back are mounted, and which is mounted, by means of a rocking mechanism, on a support frame mounted to the upper end of a center pillar. The rocking mechanism is provided, on left and right side surfaces of the seat frame, with two arc-shaped guide grooves with high centers in the front-to-back direction, and guide pins for engaging in the guide grooves are respectively attached to the support frame.

Synchro-swinging mechanisms that cause a seat surface to interact and sink with the rearward tilt of a seat back are in wide use in luxury chairs. To make them sensitive to weight, some of these are configured to interlock with the rearward tilt of a seat back and push the seat surface upward (for example, see Patent Document 2).

The chair of Patent Document 2, as shown in FIG. 16, is provided with a base 32 supported by a leg 31, and a slide mechanism 40 that connects a back support body 34 on which a seat back 33 is mounted at a first swing center axis 37, and also connects a seat support body 36 on which a seat 35 is mounted at a second swing center axis 38, and, further, connects the back support body 34 and the seat support body 36 at a third swing center axis 39, and in conjunction with the rearward tilt of the back support body 34, the third swing center axis 39 rises, in conjunction with which the slide mechanism 40 guides the second swing center axis 38 in a rear, diagonal direction.

Because the chair is so configured, the third swing center axis 39 rises when the seat back 33 and the back support body 34 tilt rearwards centered on the first swing center axis 37, and in conjunction with the rise of the third swing center axis 39 the second swing center axis 38 moves back in a diagonal direction, so that the seat support body 36 rises as a whole, supported by the second swing center axis 38 and the third swing center axis 39.

PRIOR ART DOCUMENTS

Patent Documents

Patent Document 1: JP Patent Application Publication No. 2014-4324

Patent Document 2: JP Patent Application Publication No. 2008-212622

DISCLOSURE OF THE INVENTION

Problems of the Invention to be Solved

Any chair becomes uncomfortable after a long period of sitting, and a seated person will unconsciously change position. The chair of Patent Document 1 is designed to support the seated person's ability to focus with swinging as appropriate. Also, the chair of Patent Document 2 is configured such that a tired person leaning back on the seat back to relax can sit for long periods without discomfort because the lower back is supported such that the pelvis does not sink.

However, these synchro-swinging mechanisms are complicated in construction, heavy, and high-priced. For this reason, chairs used in conferences, where many and various people are in attendance, are rarely ones that swing or recline, and they are stored folded and stacked when not in use. In recent years there has been a demand for this type of simple chair to come with a reclining or swinging mechanism as well.

The present invention aims to provide a lightweight, portable, and also economical tiltable chair having a recline mechanism that is comparable to a synchro-swinging mechanism.

Means for Solving the Problems

In order to solve the above objects, the tiltable chair of the present invention is configured in the following manner.

A tiltable chair comprising:

a flexible seat body having a seat back and a seat which are integrally formed; a back frame fixed to an upper part of legs, connected in a manner that allows a region around an upper-pelvis of a back portion of the seat back to tilt rearward; and, a seat frame fixed to the upper parts of legs provides a seat surface which can be moved forward and upward according to the rearward tilt of the seat back that, and seat-surface movement means causing the seat surface to move when the seat back is tilted rearwards, the connection of the seat back with the back frame being such that the seat back can move in the vertical direction preferably by means of connectors, e.g. with a pin or the like provided to a vertical arc groove on the connectors, and the seat-surface movement means having two arc-shaped guide rails with high centers provided to the right and left side of the underside of the seat surface, and having guide members which are engaging in the guide rails and that are supported axially on the seat frame, and which are moving smoothly according to the movement of a seated person leaning against the seat back and to the flexibility of the lower part of the seat back, while moving the seat surface forward and upward along a curved line such that the angle of the seat surface gradually increases and the ischium sinks below the lower part of the knees when the seat back tilts rearward, characterized by the guide rail being connected to a trochoid curve that is the trajectory drawn by a guide member between the position of the seat surface when the seat back is upright and the most forward position of the seat surface, with the seat body being positioned inside the circle of a virtual arc and the virtual arc rolling for a predetermined angle on the horizontal of the upper surface.

This chair may be used in an office, as well as for a conference.

Here, the terms "forward portion" and "forward direction" are used to indicate the direction in which an individual is seated.

The seat surface is integrally formed with the seat back (called a seat body), but they do not need to be of one piece.

The material can be synthetic resin, wood, or metal, but must be flexible. The degree of flexibility is good if, when a seated person leans against the seat back, a rearward tilt is possible from the site where the back frame is connected, and the part below the point of connection and the seat surface are able to move forward along a gentle curve. It is desirable that the section from the back frame connection site up to the seat surface is formed to bulge rearwards from the connection site. The seat surface has a guide member or guide rail fixed to its lower surface, so it should be made rather rigid.

In the seat body a seat back is connected to the back frame attached to the upper parts of the legs so as to be able to pivot forward and back, and a seat surface is supported by a seat frame attached to the upper parts of the legs by way of a movement means.

The back frame is attached at its lower end to the upper ends of the rear legs, and a seat back is connected around the upper pelvis area of the back portion. According to one embodiment, it can be attached at its lower end to the upper ends of legs, and can have integrated armrests of a prescribed height enclosing the left and right of a seat surface. For the connection to the seat back, a vertical, arc-shaped groove is provided to one side of a connector fixed to the back frame and seat back, and the seat back is able to move in the vertical direction by means of a pin or the like. The seat back therefore reclines smoothly. Here, a pin engages with the arc-shaped groove and allows movement in the up-down direction. However, a pin is only an example for a connecting means. Any protrusion formed integrally with the connector may be used to perform the function of the pin. The point of connection between the seat back and the back frame is below the height of the armrest, so the line from the armrest to the seat back connecting point may not be horizontal but inclined. Moreover if the connection of the seat back with the back frame is changed to a vertical arc groove and the connection is by means of an elastic member or spherical bearing that can be pivoted in multiple directions, the seat back can be made to follow movements of the seated person, such as when a person twists around to look directly behind.

Further, as seat-surface movement means, guide rails can be fixed to the left and right of the seat frame, and guide members that engage with and roll in each guide rail are supported by shafts on the underside of the seat surface. If the guide member is designed as a flexible member that uses urethane rubber, it is quiet and durable. It is also possible to make the seat surface move smoothly using a rolling bearing. The guide rail guides the seat surface in such a way that, when a seated person leans against the seat back, the seat surface moves forward and upward along a predetermined track as the seat back tilts rearward. While there are no particular restrictions on shape or configuration, forms such as a curved pipe or arc-shaped groove with a high center are convenient.

When a guide rail is configured with an arc-shaped groove it can be fixed to the seat frame, as above, but when it is an arc-shaped groove with a low center it can be attached to the left and right of the underside of the seat surface, the guide members supported by shafts in the seat frame so as to fit into and roll in the respective arc-shaped grooves. The weight of the seated person is supported by guide members fitted into the arc-shaped grooves, so the more guide members there are, the smaller each guide member can be, and the more stable is the support. In general, it is advantageous to provide four arc-shaped grooves and guide members, to the front, back, left and right.

Also, it is advantageous to provide guide rails formed with single arc-shaped grooves, one each to the left and right, and to fix a guide rail formed with a single arc-shaped groove that shifts forward and back in the central portion between left and right. In this case the weight of the seated person is supported with three guide members. When a guide rail is formed with a pipe, the pipe can be curved in a line that corresponds to the trajectory of a guide member that engages with the pipe, and a guide member for engaging with this can be mounted by a pin on a shaft bracket fixed to the underside of the seat surface. The pin can be pivotable. With the center line of a pipe bent to form a guiding line, a guide member can be mounted on the underside of the seat surface so as to slide along the center line of the pipe.

The guiding shapes of the curved line of the pipe or the arc-shaped groove in the guide rail determine the movement of the seat surface and greatly affect the feeling. The inventors made and tested several configurations in this regard, and learned that for smooth motion it is advantageous to have a particular curve between the position of the seat surface when the seat back is upright and the most forward position of the seat surface.

With reference to FIGS. 14 and 15, the creation of this particular curved line is explained. For example, a seat body is positioned in a circle of a virtual arc (e.g. of 3000 R), and a trajectory (trochoid curve) drawn by the initial position of a guide member when the arc rolls for a predetermined angle over the horizontal of the upper surface is used. The position of the chair in the virtual arc is usually close to the outer periphery, but it can be set to what is comfortable in light of the relationship of the diameter of the virtual arc, the angle of rolling, and to the length of the guide grooves, and it can also be placed closer to the center of the virtual arc. Also, the distance of the movement can be freely selected, but a practical distance is 20-50 mm.

When two guide rails are provided at the front and back, the dimensions of the arc-shaped grooves are not the same, and the trajectory S1, S2 (trochoid curve) needs to be traced by the starting points of each guide member. FIG. 15 shows the movement of a seat surface, with trajectories for the starting point S2 of a front-side guide member and for the starting point S1 of a rear-side guide member, when a virtual arc of 3000 R is rolled on the horizontal of the upper surface.

A suitable angle for the seat surface in its final position is a tilt of about 10 degrees in the forward direction relative to a horizontal surface. Also, when a person is seated it is advantageous to position the center of gravity at the front side of the connecting part of the seat back, such that when the seat back is leaned upon it tilts back quickly, and the seat surface moves forward and upward.

The front end portion of the seat surface comes into contact with the seat frame when a person sits down, and when the seat moves back and forward. Since it slides, a sliding receiver of synthetic resin is provided to the front frame of the seat frame, as well as a sliding member for guiding the front end of the seat surface is fixed to the underside of the front portion of the seat surface.

This sliding receiver and sliding member support the load on the seat surface and also prevent rapid sliding, so it is desirable that they have support strength and an appropriate degree of friction.

As with the arc-shaped groove, the shape of the lower end of the sliding member can be set to the trajectory (trochoid curve) traced by the point of contact between the sliding member and the sliding receiver when the seat body is positioned inside a circle of a virtual arc (e.g. 3000 R), and this arc rolls for a predetermined angle over the horizontal of the upper surface.

When a sliding receiver and sliding member are used, there can be one guide member for the movement device of the seat surface in the front-to-back direction.

It is desirable that the seat surface is in the rearmost position when no one is seated on the chair. A convenient means for this is to provide a return member of rubber or a coiled spring connecting the rear surface portion of the seat surface to the seat frame.

Further, if the back frame is integrally formed with an armrest, the seat and back frame can be one piece, and the legs can easily take a variety of forms. For example, the legs can be four legs made of pipe, all cantilevered legs, or either four or five legs having center pillars, any of which is easy to assemble.

Effects of the Invention

The tiltable chair of the present invention is a flexible chair in which the seat back and seat are formed integrally, the seat back is able to tilt rearward in the back frame, and also the seat surface of the chair body is supported by a seat frame provided to the upper parts of legs. For the seat back connection, a vertical, arc-shaped groove is provided to one side of a connector fixed to the back frame and seat back, with the seat back connected so as to be able to move in a vertical direction. The seat-surface movement means has guide rails to the left and right of the seat frame in such a manner that the seat surface moves in a a trajectory of a trochoid curve forward and upward, such that the angle of the seat surface gradually increases, and such that, as the seat back tilts rearward, the ischium is below the lower part of the knees. In addition, rolling guide members for engaging with each guide rail are supported by shafts on the underside of the seat surface, which provides a tilting mechanism, comparable to a luxury synchro-rocking mechanism, which allows a seated person to pleasantly rock by moving his center of gravity. Therefore, it is possible to sit for long periods without tiring, and without experiencing discomfort.

EMBODIMENTS OF THE INVENTION

An embodiment of the tiltable chair of the present invention is described with the example of an office chair having armrests.

Figure 1:
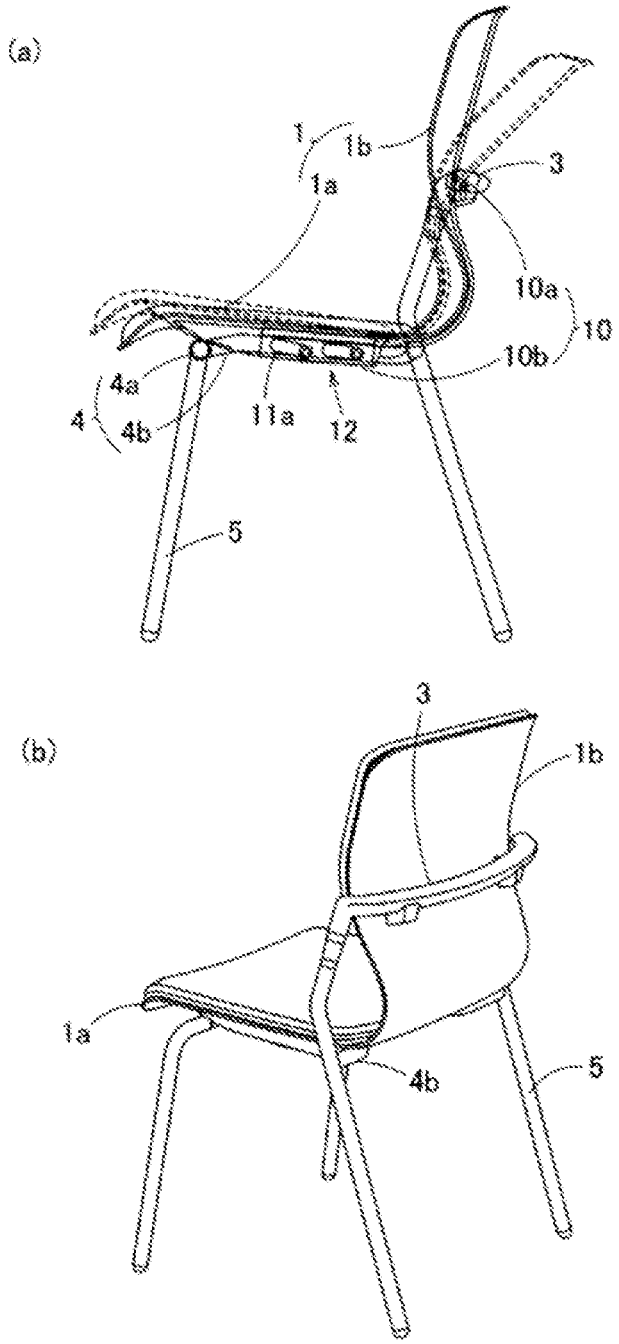
FIG. 1 (*a*) is a side view showing the tilt chair embodied as a chair used in an office, and (b) is a perspective view of (a) from the back.
Figure 2:
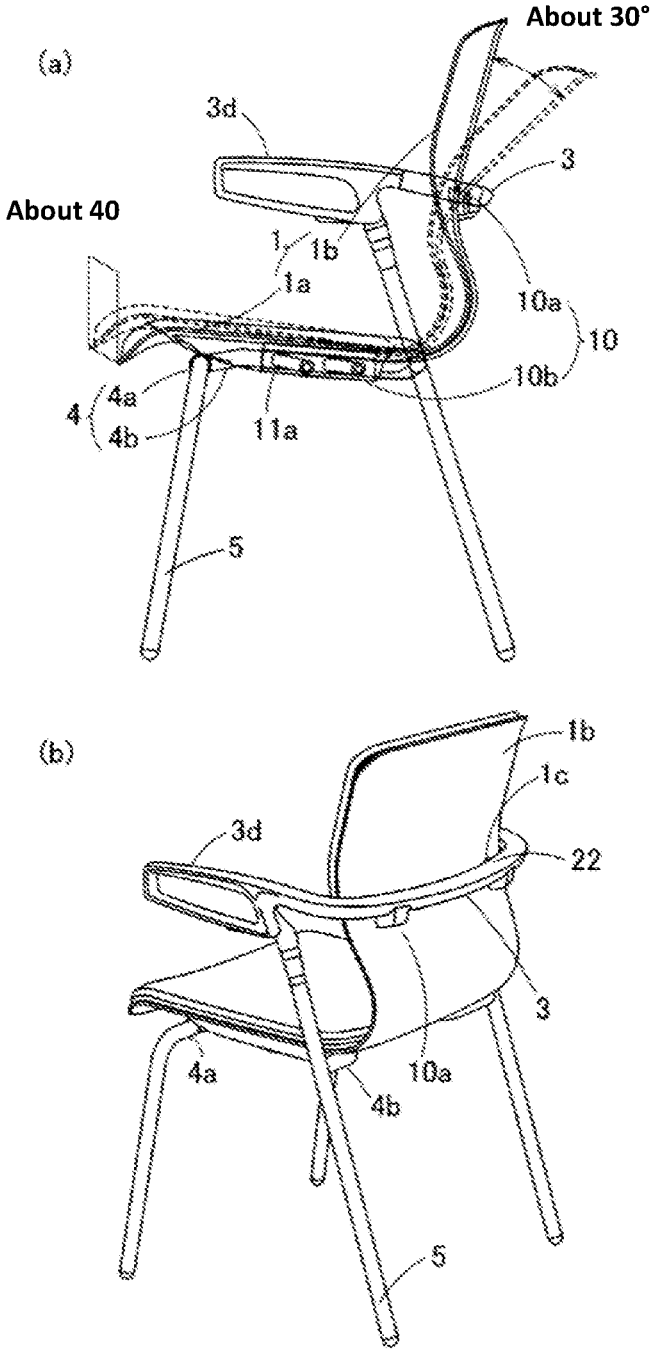
FIG. 2 shows an office chair in an embodiment wherein (a) is a side view and (b) is a perspective view from the back.
Figure 3:
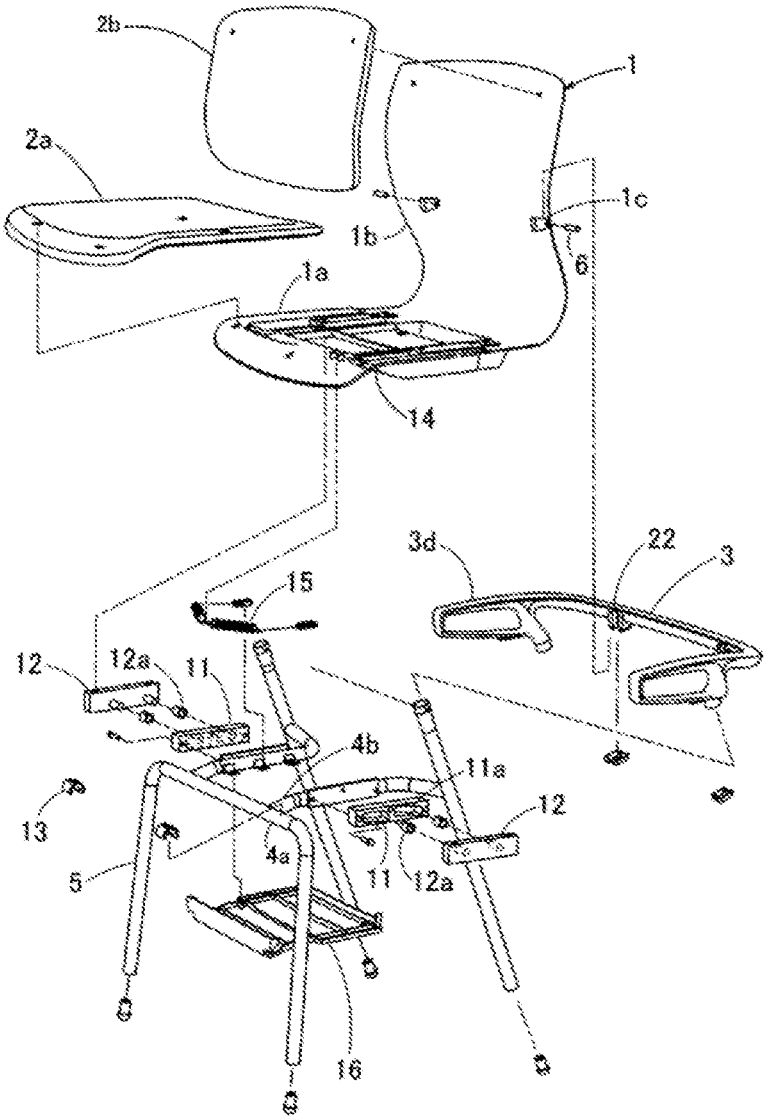
FIG. 3 is an exploded perspective view of components of the tiltable chair of FIG. 2.

FIG. 2(*a*) is a side view of the tiltable chair, (b) is a perspective view seen from the back side, and FIG. 3 is an exploded perspective view of the components of that configuration.

In this chair a back frame 3 is attached to the upper parts of four legs 5 that do not vertically expand or contract, a seat frame is attached to the upper parts of the legs 5. A seat body 1 in which a seat back 1*b* and a seat surface 1*a* are of one piece is assembled thereupon by means of a tilting device 10. In addition, in FIGS. 3, 2*a* and 2*b* are cushions.

The back frame 3 is formed integrally with an armrest 3*d*, and is positioned on the back surface of the seat back 1*b* at about upper-pelvis height (here, it is set to about 19 cm from the seat surface), and at the right and left of the seat surface 1*a* at a prescribed height above the seat surface (here, about 22 cm).

The seat frame 4 comprises a front frame 4*a* connected to the upper parts of coupled, pipe-shaped front legs 5, and a rear frame 4*b* that connects the front frame 4*a* and each of the back legs.

The tilting device 10 is configured with a seat back connection means 10*a* and a seat-surface movement means 10*b*. Here, a seat body 1 made of one piece with a flexible synthetic resin is used. Further, the seat back 1*b* is formed, as shown in FIG. 2(*a*) in a side perspective, with a form that bulges in the downward and rearward directions from the point of connection with the back frame 3.

Figure 4:
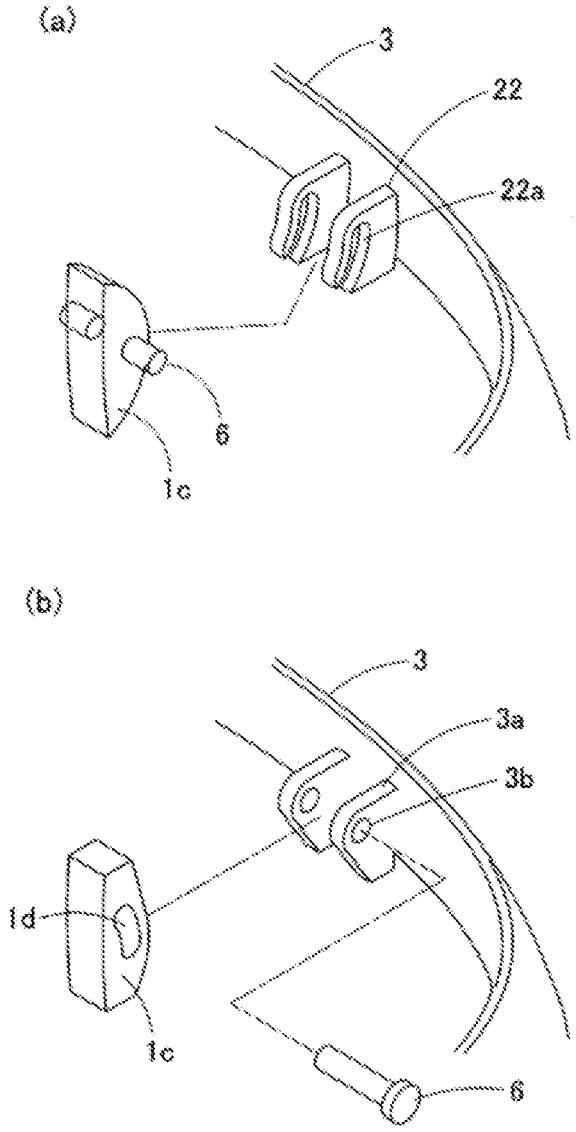
FIG. 4 is a perspective view showing a means for connecting a seat back with a back frame, wherein (a) shows an embodiment with an arc groove provided to a connector 22 of a back frame 3, and (b) shows a vertical, arc-shaped groove provided to a connector 1*c* of a seat back.

As shown in FIG. 4(*a*), the seat back connection means 10*a* comprises connectors 22 which are fixed to the right and left of the back frame 3 and positioned in an area near the upper part of the pelvis on the back side of the seat back 1*b*, and are connected to connectors 1*c* that are fixed to the back surface of the seat back 1*b*.

The connectors 1*c* of the seat back 1*b* provide a pin 6, and the connectors 22 of the back frame 3 comprise a vertical arc groove 22*a*. When the seat back 1*b* tilts, the pin 6 is able to move inside the vertical, arc-shaped groove 22 so that the seat back 1*b* tilts back smoothly. There is an opening in the lower part of this vertical arc groove 22*a*, and during assembly, the pin 6 of the connector 1*c* can simply be fitted to the lower part of the arc groove 22*a* while the seat back 1*b* of the seat body 1 is held.

The seat-surface movement means 10*b*, as shown in FIGS. 2(*a*) and 3, has one guide rail 11 to the right and one to the left, with two arc-shaped grooves 11*a* formed in the front-to-back direction in the seat frame 4*b*. Guide members 12*a*, supported by shaft brackets 12 fixed to the underside of the seat surface 1*a* are engaging the curved grooves 11*a* in a pivotable manner. The arc-shaped grooves 11*a* are formed with having a high center.

The shape of the arc-shaped groove 11*a* determines and creates a trajectory for the seat surface 1*a* to smoothly move forward and upward about 40 mm in the process of the seat back 1*b* tilting rearward 30 degrees, using the pin 6 of the connection means 10*a* as a fulcrum. Here, the arc-shaped groove 11*a* determines a trajectory (trochoid curve) which is the center line of the arc-shaped groove and is drawn by the starting point of a guide member 12*a* that is fitted into the arc-shaped groove when the seat body is positioned close to the periphery of a circle with a radius of 3000 mm, and the arc rolls for a prescribed distance over the horizontal surface of the upper surface.

In addition, sliding receivers 13 are fixed to the front frame 4*a* of the seat frame 4, and a sliding member 14 is fixed near the front portion of the underside of the seat surface 1*a*. The sliding receivers 13 provide a synthetic resin wound in a semicircle around the frame 4*a* made of steel tubing. The shape of the lower end of the sliding member 14, like the above-described arc-shaped groove 11*a*, is determined by a trajectory (trochoid curve) traced by the point of contact between the sliding member 14 and the sliding receivers 13 when the seat body is placed close to the periphery of the circle of a virtual arc (e.g., 3000 R), and this arc rolls with a prescribed angle over the top surface.

Further, one end of a return member 15 (here, a return spring is used) is locked to the seat frame 4 such that the reclined seat back 1*b* returns smoothly, and the other end is locked to the underside of the seat surface 1*a*. An addition, in FIG. 3, 16 is a cover provided.

Because it is configured in this manner, the seat body 1 is in the rearmost position due to the return member 15, and the seat back 1*b* is more or less perpendicular when a seated person is not leaning back on the seat back.

When a seated person leans back on the seat back, the pin 6 in the connector 1*c* of the seat back 1*b* engages with the arc groove 22*a* of the connector 22 of the back frame 3 and, using this as a fulcrum, the upper side tilts rearward from the back frame 3 of the seat back 1*b*. As this happens the curved portion of the seat back 1*b*, between the connection point (connector 1*c*) and the seat surface 1*a*, bends, and the seat surface 1*a* moves forward and upward, guided by the guide rail 11. Thus, the chair enters a reclining state.

FIG. 2(*a*) shows the state of movement of the seat body 1 when the seat back 1*b* of the tilt chair tilts rearward. Straight lines indicate a state in which the seat back is upright, and dotted lines indicate a state in which the chair is at maximum tilted rearwards. The weight of the seated person becomes the reaction force for the rearward tilt of the seat back, so almost no difference in sitting comfort is experienced due to differences in weight.

Next, different embodiments of the connecting means 10*a* for the seat back are explained with reference to FIG. 4(*b*).

Here, the connecting means is used for the backrest 1*b* and provide a connector 3*a* fixed to the left and right sides of the back frame 3 on the back of the seat back 1*b* and being coupled to the connector 1*c* by a pin 6. The connector 1*c* is fixed to the back surface of the seat back 1*b*. A vertical arc groove 1*d* is formed in the connector 1*c* and, because the pin 6 is able to move inside the vertical arc groove 1*d* when the seat back 1*b* tilts rearward, the seat back 1*b* tilts rearward smoothly. The function of the connection means 10*a* is the same as in the case of FIG. 4(*a*).

A different embodiment of the seat back connection means 10*a* is explained with reference to FIGS. 5(*a*) and 5(*b*).

Figure 5:
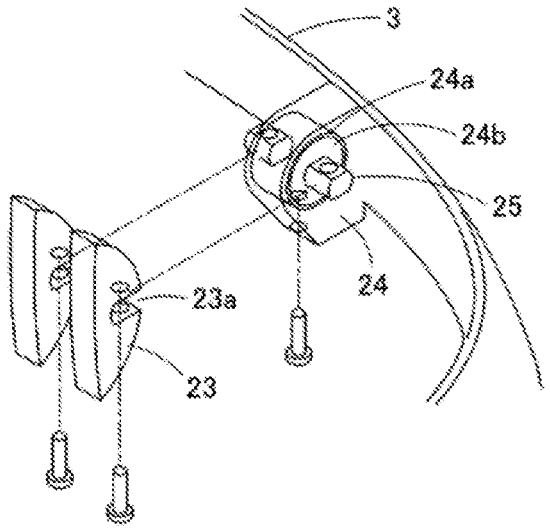
FIG. 5 is a perspective view showing other embodiments of a connector for the seat back, wherein (a) shows a seat back connected to a back frame via an elastic body and (b) shows a seat back connected to a back frame via a spherical bearing.
Figure 5:
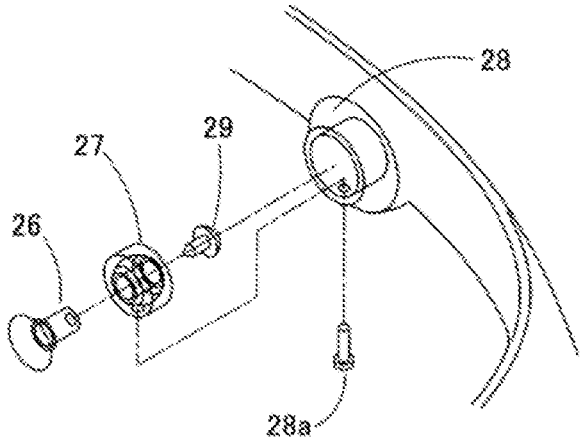

In FIG. 5(*a*), the connection means 10*a* provides a connector 24 on the back frame 3, with a pin 25 and an elastic rubber body 24*b* melted or glued between the pin 25 and an outer tube 24*a*. The pin 25 is fixed to a connector 23 on the seat back 1*b*. The point of connection can be only at the center of the back frame 3 in the right-left direction, or the connection can also be provided to the left and right of the seat back, as above. The connector 23 is formed with a pinhole 23*a* that opens in the horizontal direction, and fits to the pin 25 with having flat upper and lower surfaces, the pin 25 being secured by a screw. Because it is configured in this way, the upper part of the seat back 1*b* tilts rearward when the seat back 1*b* is leaned upon and the elastic body 24*b* deforms. The ability of the elastic body 24*b* to return to shape helps it to return with a light movement.

The seat back connection means 10*a* in FIG. 5(*b*) connects the seat back 1*b* to the back frame 3 by way of a spherical bearing 27. The shaft part of a mounting member 26 fixed to the seat back 1*b* fits into the spherical bearing 27 and is secured with a retaining pin 29, and this fits into a mounting part 28 provided to the back frame 3, with the outer ring of the spherical bearing 27 secured by a pin 28*a*.

There can be a point of connection only at the center between left and right of the back frame 3 or, as with the above seat back 1*b*, points of connection can be provided to the left and right of the seat back 1*b*. If a seated person turns to look behind or does a spinal stretch, etc., the seat back follows the movement according to the flexibility of the spherical bearing 27 and the seat back 1*b*.

Next, a different embodiment of the seat-surface movement means 10*b* is explained with reference to FIGS. 6 and 7.

Figure 6:
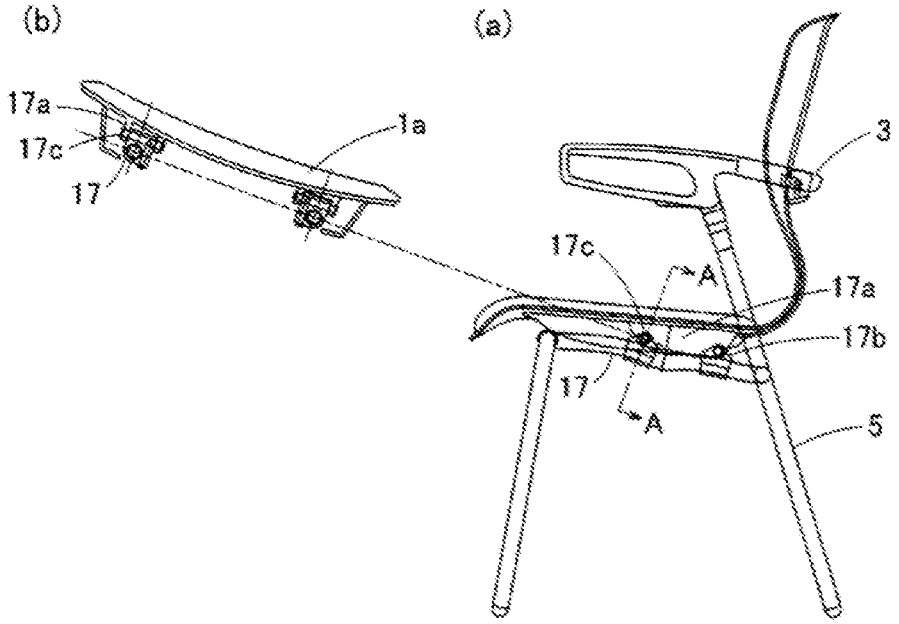
FIG. 6 shows an embodiment of the invention wherein (a) is an entire side view and (b) shows a cross-section A-A of (a).
Figure 7:
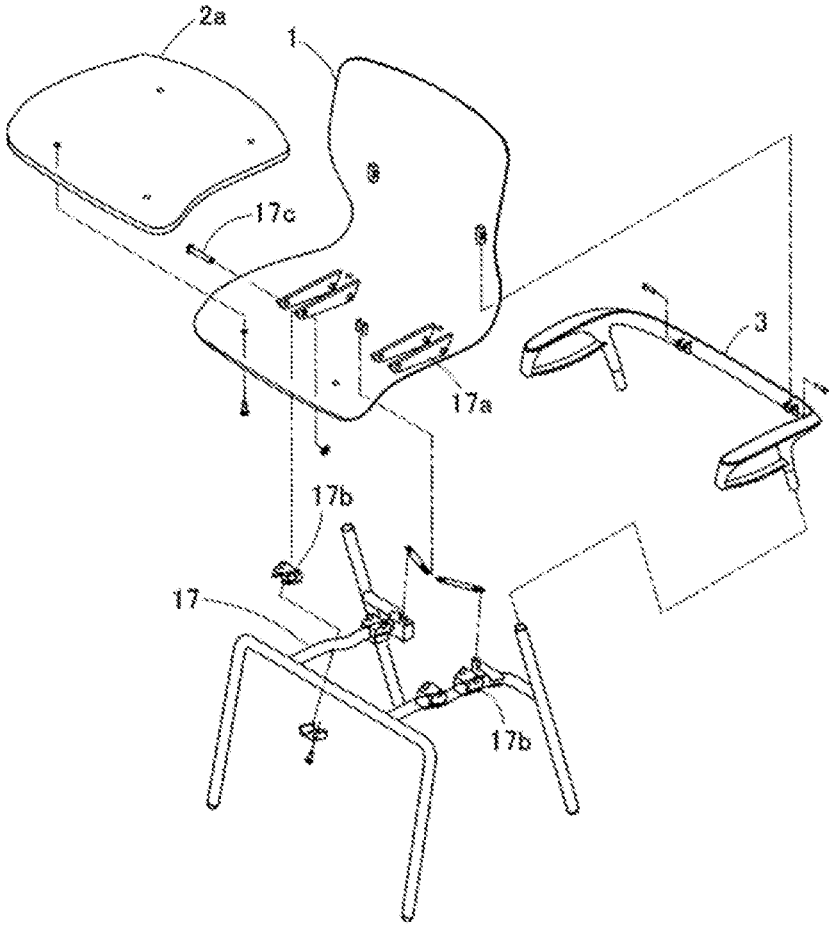
FIG. 7 is an exploded perspective view of components of the tiltable chair of FIG. 6.

In the seat-surface movement means 10*b* shown in FIG. 6(*a*), one pipe-shaped guide rail 17 (in this example also serving as a rear frame 4*b*) is fixed to the right side and one is fixed to the left side, and a guide member 17*b* sectioned into two pieces, upper and lower, engages in a slidable manner with the outside of the guide rail 17. The guide member 17*b* is connected by a pin 17*c* to a shaft bracket 17*a* fixed to the underside of the seat surface 1*a*.

Here, the guide rail 17 is formed in a curve such that the trajectory on which the pin 17*c* moves is the trochoid curve mentioned above. The pin 17*c* is connected in such a way that it can freely pivot. With this device, as with the movement means 10*b* of the seat surface of the above embodiment, when the seat back 1*b* tilts rearward, the seat surface 1*a* moves under the guidance of the guide rail 17.

Figure 8:
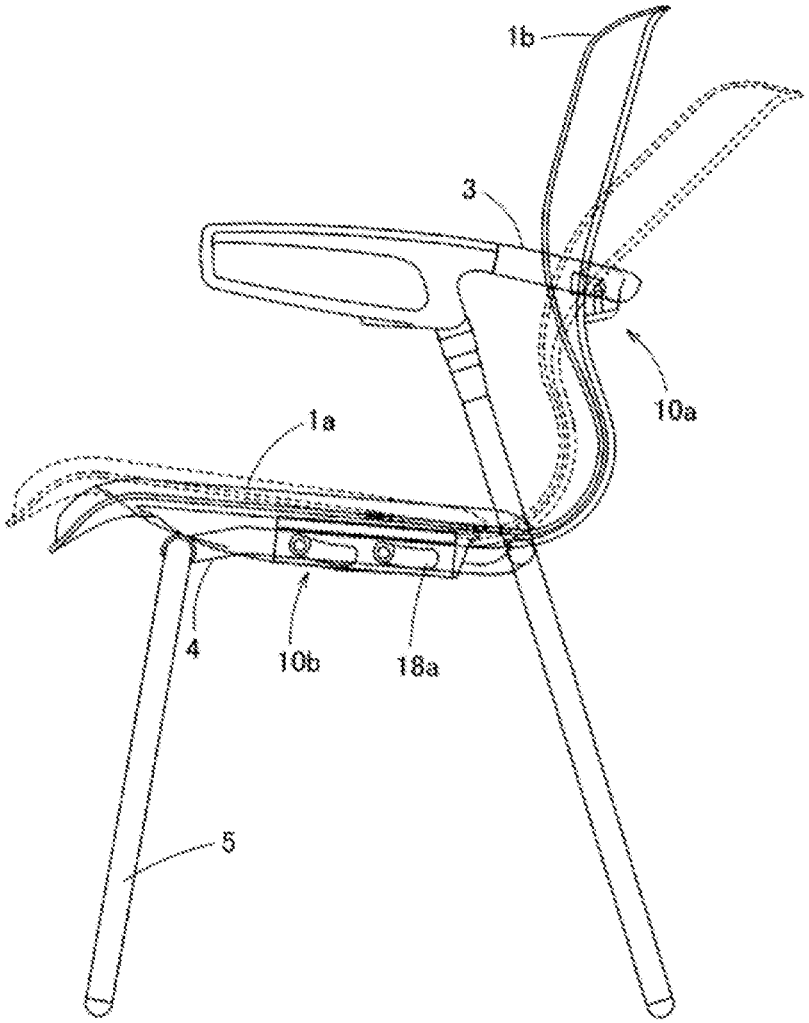
FIG. 8 is a side view showing an embodiment of the invention.
Figure 9:
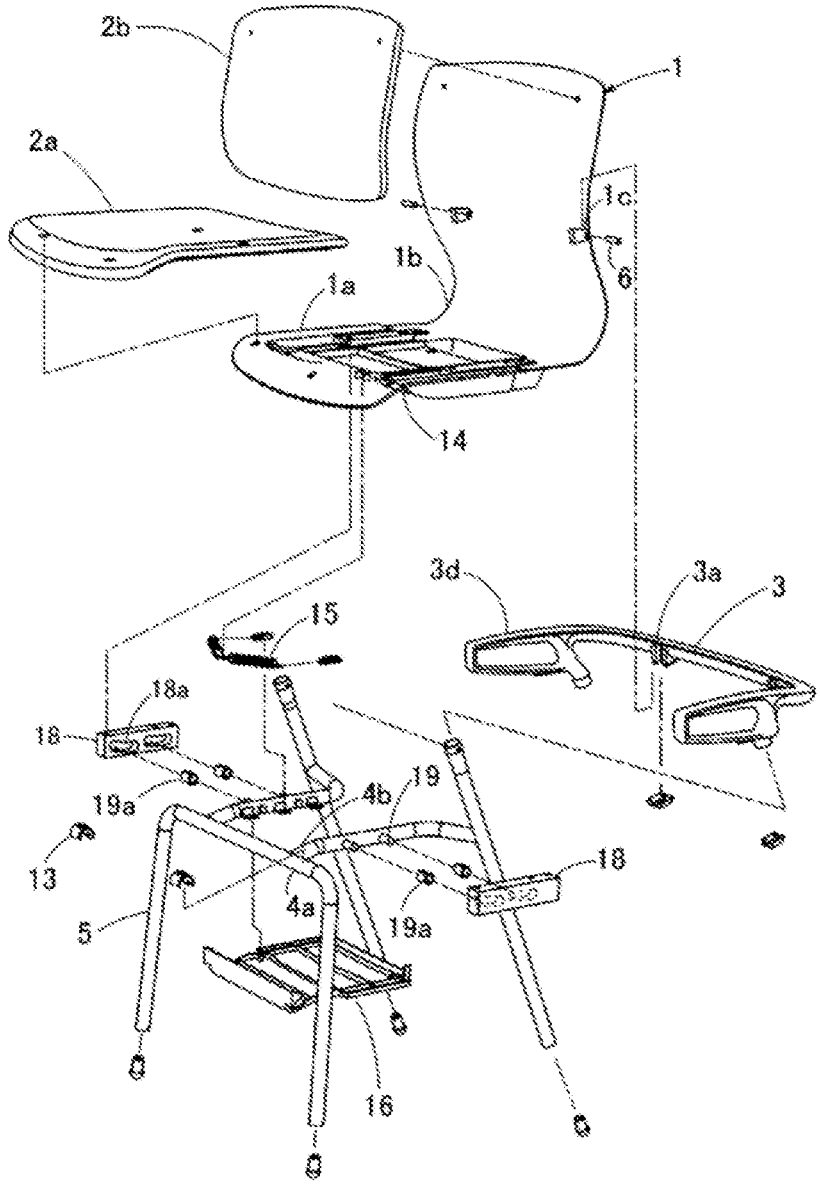
FIG. 9 is an exploded perspective view of components of the tiltable chair of FIG. 8.

Another embodiment of the seat-surface movement means 10*b* is explained based on FIGS. 8 and 9. This is similar to the above embodiment (FIG. 2, 3) with the difference that a guide rail 18 is fixed to the underside of the seat surface 1*a*, and a guide member 19*a* for engaging with and rolling in an arc-shaped groove 18*a* is supported by a shaft 19 fixed to a seat frame 4. In this case, the guide rail 18 moves with the rearward tilt of the seat back. Here, the arc-shaped groove 18*a* is formed with a low center, unlike the above case.

If a seat body becomes one piece by connecting separate members, it can be manufactured by a small-scale manufacturing facility. An embodiment of this case is explained with reference to FIGS. 10 and 11.

Figure 10:
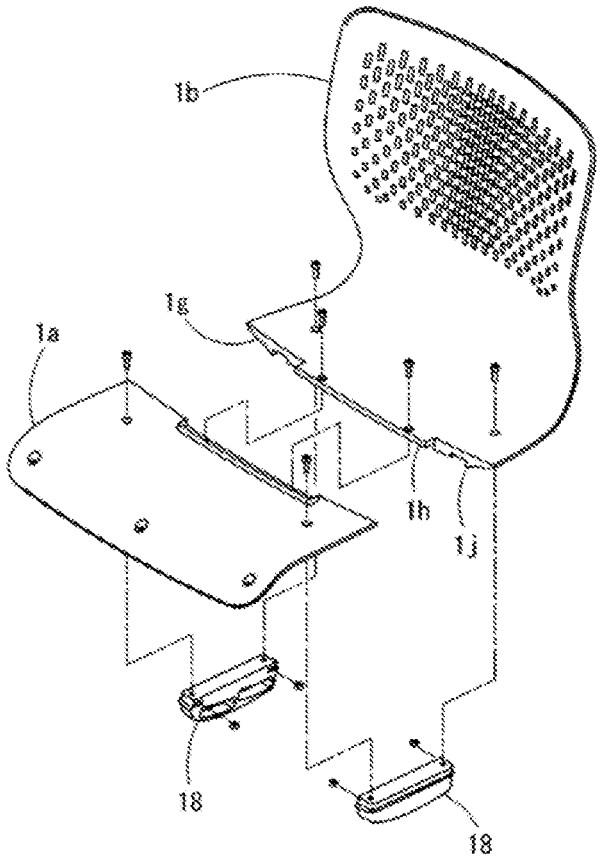
FIG. 10 is a perspective view of a seat body fixed to the rear portion of a seat surface.

FIG. 10 shows the seat connections from slightly behind and from the side of a seat surface 1*a*. A projecting part 1*h* is formed at the rear part of the seat surface 1 the area of a joint 1*g*, and is attached to the forward part 1*a* of the seat surface 1 by fitting into the recessed part formed thereon. A rib 1*j* having flexibility is formed on the underside of the seat surface 1*a*.

Figure 11:
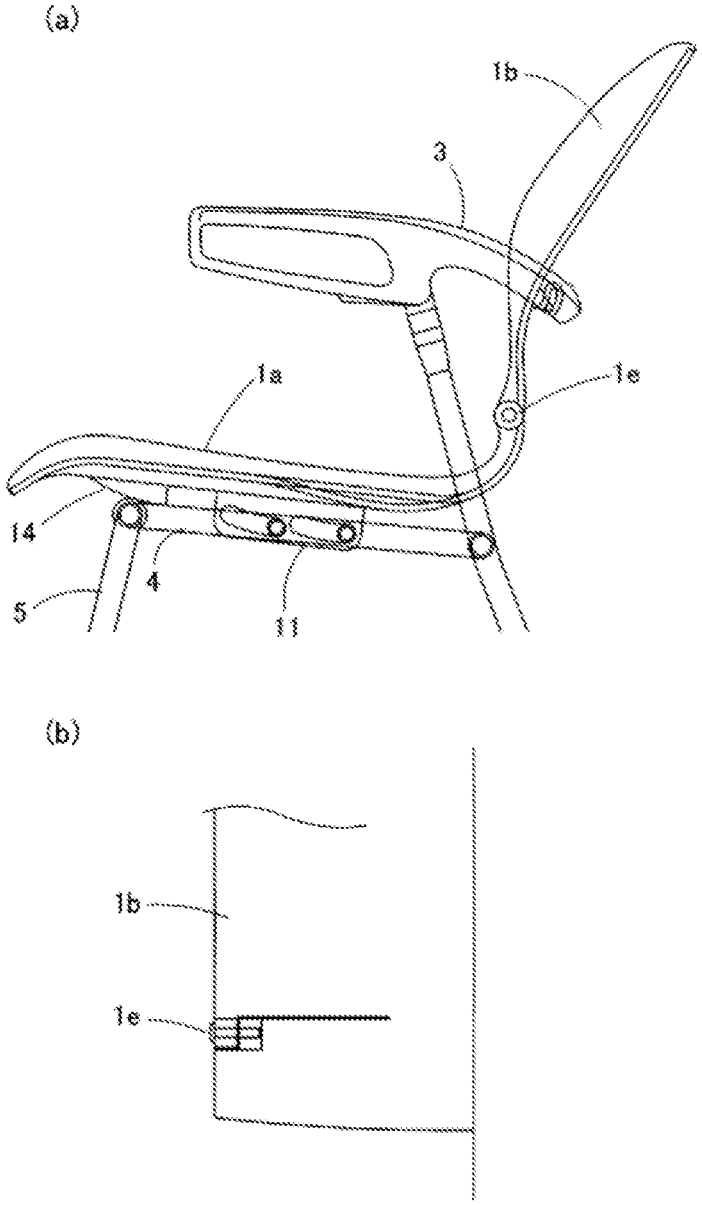
FIG. 11 (*a*) is a side view of a tiltable chair using a seat body connected close to the lower end of a seat back and (b) is a rear view.

Further, in FIG. 11, below the connector that connects the seat back 1*b* with the back frame 3, connections are made with a connecting member 1*e* formed e.g. by elastic rubber. Because it is configured in this way, when the seat back 1*b* is leaned upon it bends more at the connecting member 1*e*. For this reason, a material that is somewhat lacking in flexibility can be used for the seat body.

Next, an embodiment of a chair having various leg types, in which the seat body and back frame are one piece is explained with reference to FIGS. 12 and 13.

In the above explanations of embodiments, the configuration had four legs that could not raise or lower or rotate the seat surface, but it is possible to install various types of legs. Here, the back frame 3 is the same for various types of legs 5.

Figure 12:
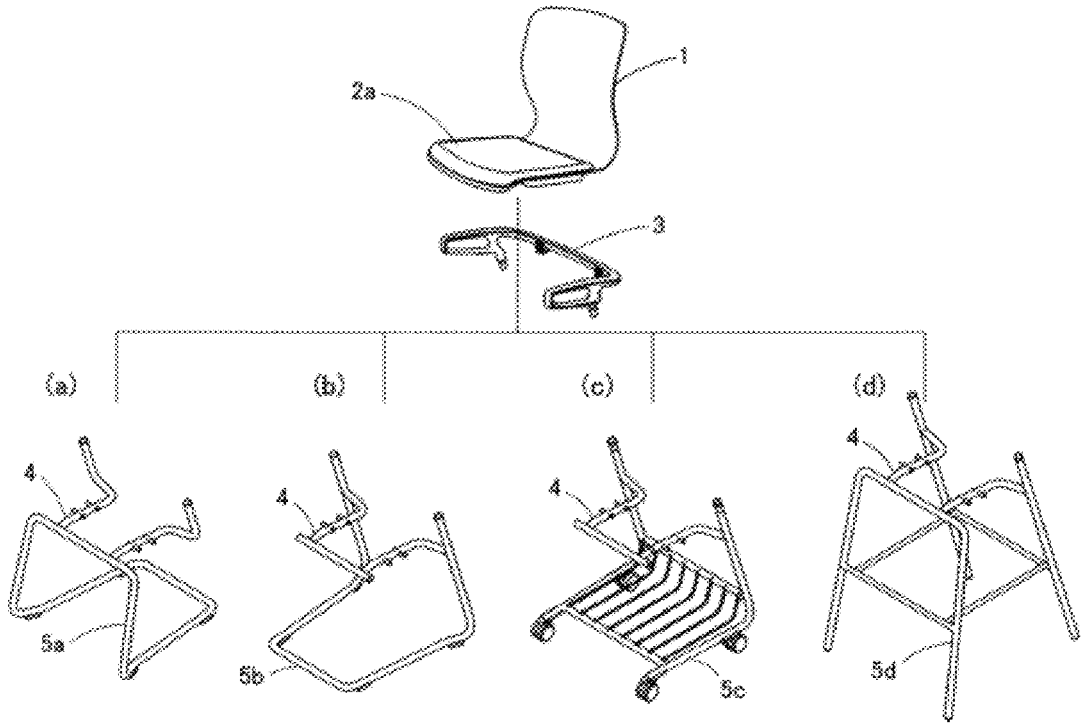
FIG. 12 is a perspective view showing a chair, wherein the same piece is used for the seat body and back frame, and various legs are used. (a) shows a cantilever, (b) shows a reverse cantilever, (c) shows a cantilevered load caster, and (d) shows a so-called four-legged highchair.

FIG. 12(*a*) shows what is called a cantilever type in which the front legs bend rearwards at the lower end, where the seat frame 4 is fixed to the top parts of legs 5*a*, and the back frame 3 is connected to the top parts of legs 5*a*. Further, FIG. 12(*b*) shows what could be called a reverse cantilever in which the rear legs bend forward at the lower end, and the upper end of a leg 5*b* connects to the back frame 3. In FIG. 12(*c*) caster wheels are provided to the legs 5*b* of 12(*b*) configured such that luggage can be placed on the leg surface.

In addition, in FIG. 12(*d*) the four legs 5 shown in FIG. 2(*a*), (*b*) extend to adapt to a high desk or table.

Figure 13:
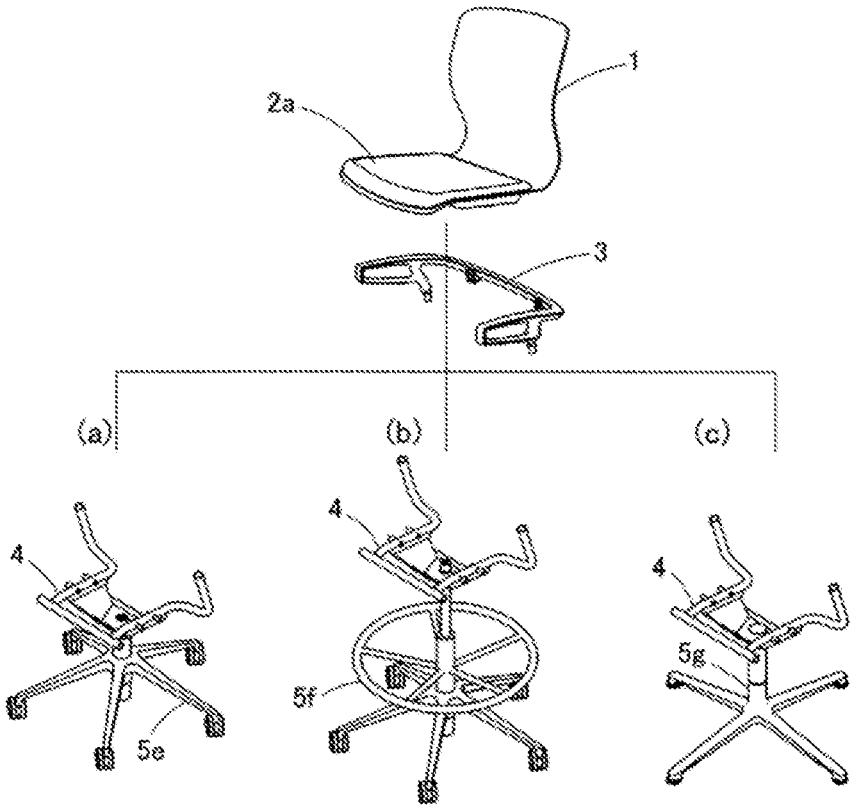
FIG. 13 is a perspective view showing an embodiment in which various legs equipped with center pillars are attached, wherein (a) shows a five-legged caster, (b) shows a five-legged highchair, and (c) shows a so-called four-legged type.
Figure 14:
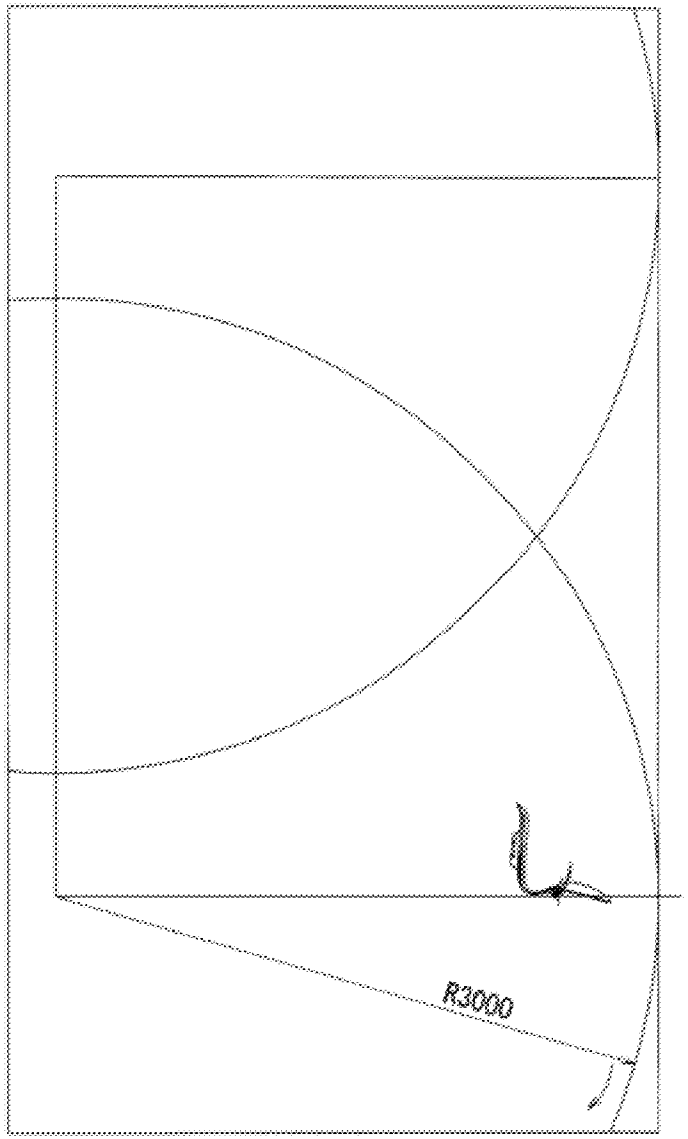
FIG. 14 is an explanatory diagram for determining the movement trajectory of a seat surface.
Figure 15:
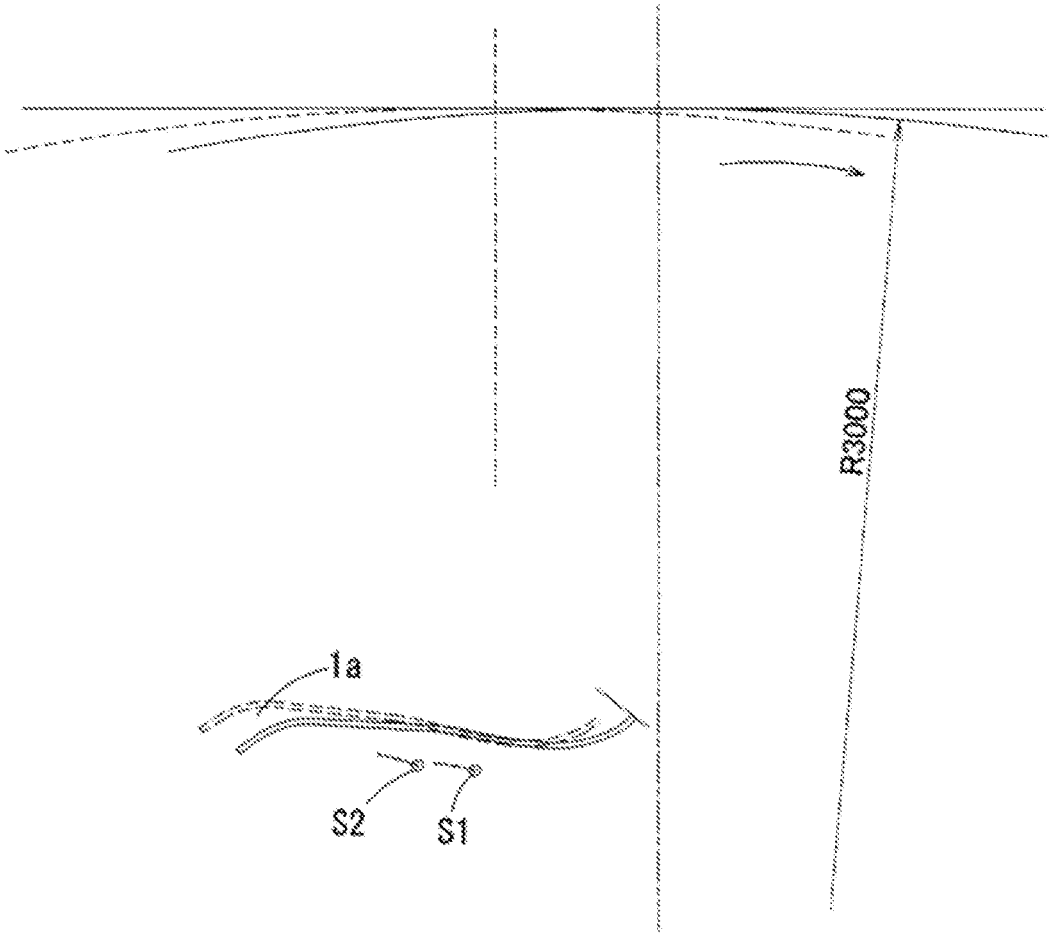
FIG. 15 is an enlarged view of the seat surface of FIG. 14.
Figure 16:
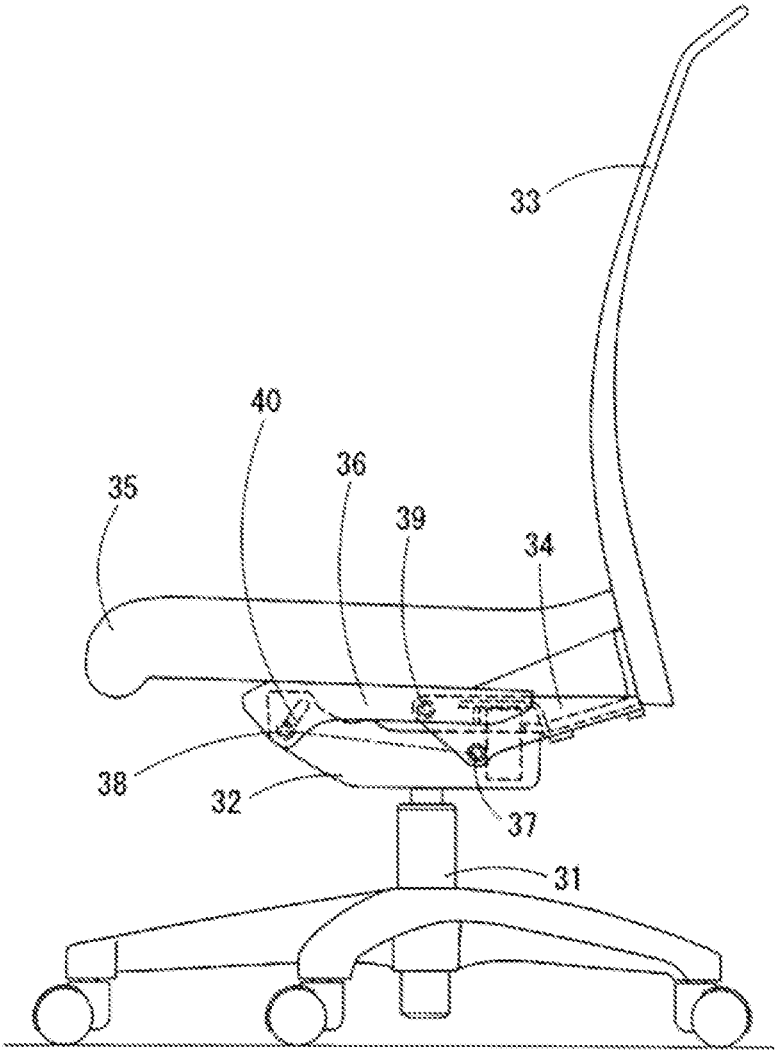
FIG. 16 is a side view of a chair equipped with an existing synchro-swinging mechanism.

In FIG. 13 a seat surface 1*a* can be raised or lowered and rotated.

FIG. 13(*a*) shows a five-legged chair with caster wheels, with a seat frame 4 being fixed to an upper part of a center pillar comprising the five legs 5*e* having caster wheels thereon. Further, FIG. 13(*b*) shows what might be called a five-legged highchair, with the center pillar of FIG. 13(*a*) extended, and a leg rest 5*f* provided thereto. FIG. 13(*c*) shows what can be called a four-legged type, equipped with four legs 5*g* not provided with caster wheels.

The tilt chair of the present invention can, of course, be used not only as an office chair but anywhere, such as in meeting rooms or conferences.

While the above embodiments of the present invention are described with specific measurements, this is for ease of understanding the invention, and the invention is not limited thereto.

LIST OF REFERENCE SIGNS

1 Seat body
1*a* Seat surface
1*b* Seat back
1*c* Connector
1*d* Vertical arc groove
1*e* Connecting member
1*g* Joint
1*h* Projecting part
1*j* Rib
2*a* Cushion
2*b* Cushion
3 Back frame
3*a* Connector
3*b* Pin hole
3*d* Armrest
4 Seat frame
4*a* Forward frame
4*b* Rear frame
5, 5*a*-5*g* Legs
6 Pin
10 Tilt device
10*a* Connection means of seat back
10*b* Movement means of seat surface
11 Guide rail
11*a* Arc-shaped groove
12 Shaft bracket
12*a* Guide member
13 Sliding receiver
14 Sliding member
15 Tension spring
16 Cover
17 Guide rail
17*a* Shaft bracket
17*b* Guide member
17*c* Pin
18 Guide rail
18*a* Arc-shaped groove
19 Shaft
19*a* Guide member
22 Connector
22*a* Arc groove
23 Connector
23*a* Pin hole
24 Connector
24*a* Outer tube
24*b* Elastic body
25 Pin
26 Mounting member
27 Spherical bearing
28 Mounting part
28*a* Pin
29 Retaining pin
31 Leg
32 Base
33 Seat back
34 Back support body
35 Seat
36 Seat support body
37 First swing center axis
38 Second swing center axis
39 Third swing center axis
40 Slide mechanism

The invention claimed is:

1. A tiltable chair comprising:

legs;

a flexible seat body in which a seat back and a seat surface are integrally formed;

a back frame connected to an upper part of the legs with a back connector to allow a back portion of the seat back to tilt rearward in a region around an upper-pelvis area of a user;

the seat back and the back frame being connected to each other by connectors allowing that the seat back to be movable in a vertical direction;

a seat frame fixed to the upper part of the legs;

a seat surface movement mechanism configured for causing the seat surface to move forward and upward with respect to the seat frame according to the rearward tilt of the seat back;

the seat surface movement mechanism comprising two guide rails having arc-shaped structure with high centers being positioned on right and left sides of an underside of the seat surface, and respective guide members engaging the guide rails;

the seat surface movement mechanism thus causing smooth movement of the seat surface according to a movement of the user when seated and leaning against the seat back to cause the seat back to flex with respect to the seat surface and tilt rearward, such smooth movement of the seat surface being forward and upward along a curved line such that an angle of the seat surface gradually increases and an ischium of the user sinks below lower parts of the knees of the user when the seat back tilts rearward;

wherein the engagement of the guide rails with the guide members creates the curved line as a trochoid curve between a position of the seat surface when the seat back is upright and a most forward position of the seat surface, with the seat body being positioned inside a circle of a virtual arc and the virtual arc rolling for a predetermined angle on a horizontal of the seat surface;

wherein the legs include pipe-shaped front legs and pipe-shaped rear legs and the seat frame comprises a front frame connecting the pipe-shaped front legs and a rear frame connecting the front frame with the pipe-shaped rear legs, the front frame including a sliding receiver, and a sliding member, configured for guiding a front portion of the seat surface, fixed to the seat surface.

2. The tiltable chair of claim 1, wherein the back frame includes integral armrests surrounding the seat surface to the left and right at a predetermined height.

3. The tiltable chair of claim 1, wherein the guide rails are configured as arc-shaped pipes and the guide members engage outer surfaces of the pipes.

4. The tiltable chair of claim 1, wherein the sliding receiver is made of synthetic resin, and the sliding member is fixed to an underside of the front portion of the seat surface.

5. The tiltable chair of claim 1, wherein the connectors connecting the back frame and the seat back include a first connector fixed to the back frame and a second connector fixed to the seat back with one of the connectors comprising a vertical arc groove and the other connector comprising a pin engaging the vertical arc groove.

6. The tiltable chair of claim 1, wherein the arc-shaped structures of the guide rails are grooves.

7. A tiltable chair comprising:

legs;

a flexible seat body in which a seat back and a seat surface are integrally formed;

a back frame connected to an upper part of the legs and comprising a tilting device to allow a back portion of the seat back to tilt rearward in a region around an upper-pelvis area of a user;

the seat back and the back frame being connected to each other by connectors allowing that the seat back is movable in a vertical direction;

a seat frame fixed to the upper part of the legs;

a seat surface movement mechanism configured for causing the seat surface to move forward and upward with respect to the seat frame according to the rearward tilt of the seat back;

the seat surface movement mechanism comprising two guide rails having arc-shaped structure with low centers connected to the seat frame, and respective guide members connected to the seat body on right and left sides of an underside of the seat surface and engaging the guide rails;

the seat surface movement mechanism thus causing smooth movement of the seat surface according to a movement of the user when seated and leaning against the seat back to cause the seat back to flex with respect to the seat surface and tilt rearward, such smooth movement of the seat surface being forward and upward along a curved line such that an angle of the seat surface gradually increases and an ischium of the user sinks below lower parts of the knees of the user when the seat back tilts rearward;

wherein the engagement of the guide rails with the guide members creates the curved line as a trochoid curve between a position of the seat surface when the seat back is upright and a most forward position of the seat surface, with the seat body being positioned inside a circle of a virtual arc and the virtual arc rolling for a predetermined angle on a horizontal of the seat surface;

wherein the legs include pipe-shaped front legs and pipe-shaped rear legs and the seat frame comprises a front frame connecting the pipe-shaped front legs and a rear frame connecting the front frame with the pipe-shaped rear legs, the front frame including a sliding receiver, and a sliding member, configured for guiding a front portion of the seat surface, fixed to the seat surface.

8. The tiltable chair of claim 7, wherein the back frame includes integral armrests surrounding the seat surface to the left and right at a predetermined height.

9. The tiltable chair of claim 7, wherein the guide rails are configured as arc-shaped pipes and the guide members engage outer surfaces of the pipes.

10. The tiltable chair of claim 7, wherein the sliding receiver is made of synthetic resin, and the sliding member is fixed to an underside of the front portion of the seat surface.

11. The tiltable chair of claim 7, wherein the connectors connecting the back frame and the seat back include a first connector fixed to the back frame and a second connector fixed to the seat back with one of the connectors comprising a vertical arc groove and the other connector comprising a pin engaging the vertical arc groove.

12. The tiltable chair of claim 7, wherein the arc-shaped structures of the guide rails are grooves.

* * * * *